United States Patent [19]

Gunderson

[11] Patent Number: 4,753,713

[45] Date of Patent: Jun. 28, 1988

[54] APPARATUS FOR FORMING UNIFORM DENSITY STRUCTURAL FIBERBOARD

[75] Inventor: Dennis E. Gunderson, Madison, Wis.

[73] Assignee: The United States of America as represented by the Secretary of Agriculture, Washington, D.C.

[21] Appl. No.: 895,639

[22] Filed: Aug. 12, 1986

[51] Int. Cl.[4] ..... D21J 1/04; D21J 3/00; B29C 43/56

[52] U.S. Cl. ..... 162/383; 162/225; 162/227; 162/388; 162/400; 264/40.5; 264/86; 264/87; 264/119; 264/124; 264/296; 425/84; 425/85

[58] Field of Search ..... 425/84, 85, 110, 112, 425/117, 125, 469, 354; 264/86, 87, 40.1, 40.5, 101, 109, 119, 124, 296; 249/113, 155, 156, 157, 158; 162/218, 225, 227, 228, 230, 382, 388, 390, 396, 399, 400, 383

[56] References Cited

U.S. PATENT DOCUMENTS

| | | | |
|---|---|---|---|
| 2,714,349 | 8/1955 | Johnston | 162/399 |
| 3,306,815 | 2/1967 | Mayne | 162/228 |
| 3,697,631 | 10/1972 | Charman, Jr. et al. | 162/228 |
| 3,793,138 | 2/1974 | Rohrer | 264/87 |
| 3,989,581 | 11/1976 | Kober | 425/84 |
| 4,203,936 | 5/1980 | Kiwak | 264/87 |
| 4,219,515 | 8/1980 | Helser et al. | 264/86 |
| 4,272,318 | 6/1981 | Walker et al. | 162/382 |
| 4,289,793 | 9/1981 | Gustafson et al. | 425/84 |
| 4,568,554 | 2/1986 | Derode | 425/84 |
| 4,683,028 | 7/1987 | Waller et al. | 162/382 |

FOREIGN PATENT DOCUMENTS

| | | | |
|---|---|---|---|
| 217888 | 4/1924 | United Kingdom | 264/86 |

*Primary Examiner*—James Lowe
*Assistant Examiner*—J. F. Durkin, II
*Attorney, Agent, or Firm*—M. Howard Silverstein; David G. McConnell

[57] ABSTRACT

A sculptured structural fiberboard product is formed using a mold that includes porous forming areas which, in one embodiment, are porous forming mandrels movably mounted on the mold, and liquid impervious thimbles which removably cover the porous areas. A fiber network is formed as water is drained off through the porous areas and the thimbles are moved to gradually unveil the porous areas during the mat formation. When mandrels are used, the mandrels are withdrawn in cooperation with a pressing force applied to the mat to consolidate and dry the web. The porous areas can also act as heat and mass transfer means during consolidation and drying. An alternative embodiment permits formation of laminated products and another alternative embodiment permits close control over the product density during consolidation and drying.

8 Claims, 2 Drawing Sheets

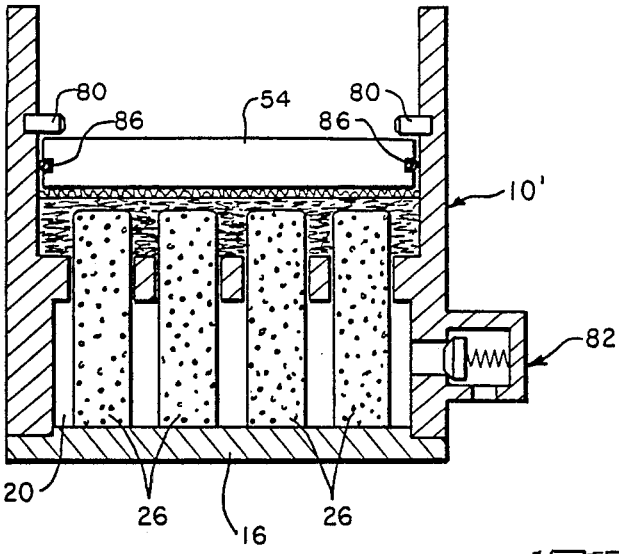
FIG. 3
FIG. 4c
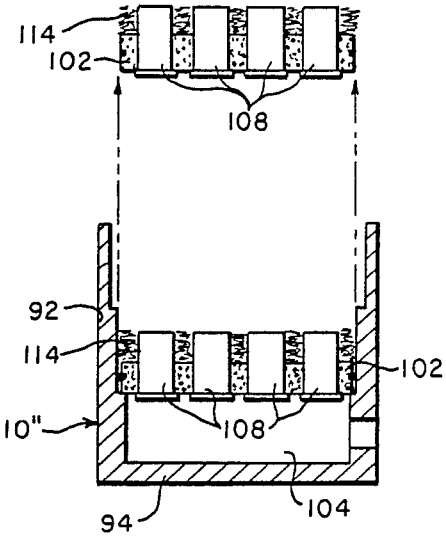
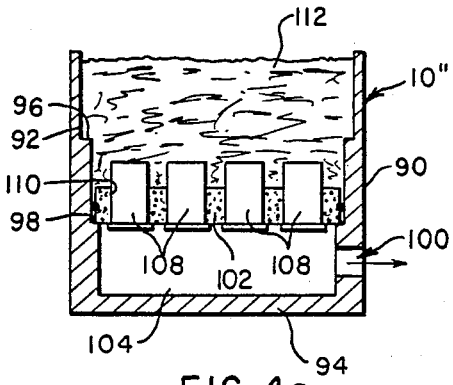
FIG. 4a
FIG. 4b
FIG. 5c
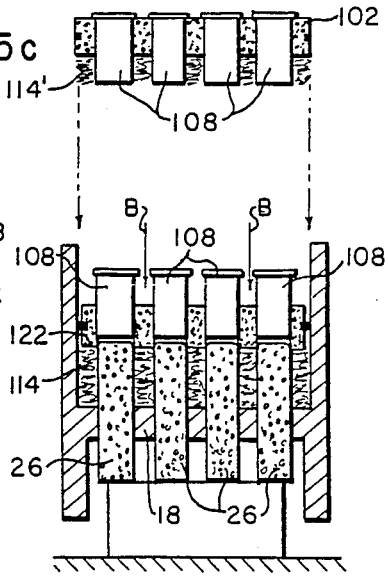
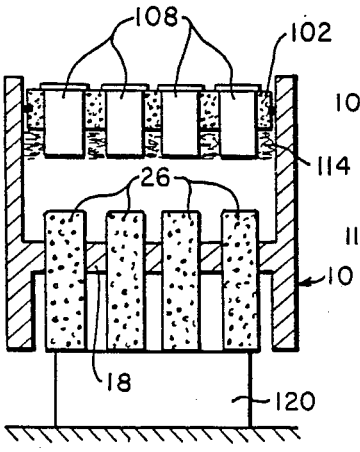
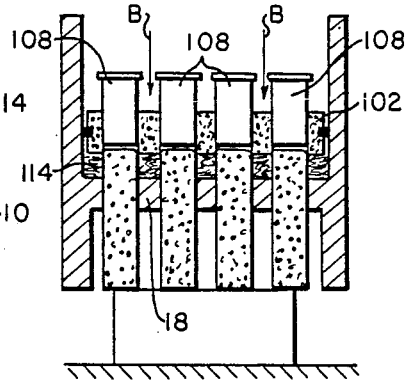
FIG. 5a
FIG. 5b
FIG. 5d

APPARATUS FOR FORMING UNIFORM DENSITY STRUCTURAL FIBERBOARD

TECHNICALL FIELD

The invention relates generally to fiberboard products, and particularly to a method and apparatus for forming, consolidating and drying sculptured structural fiberboard products.

BACKGROUND ART

Recent research has shown that, when properly formed and consolidated, wood pulp fibers can produce high performance structural products without the use of binders or adhesives. In the past, such products have been formed using solid shaping mandrels and having a wet-lay mold having the full drainage area exposed throughout the forming process. In these processes, water is drained between the mandrels, and thus drainage is slow and not well controlled, resulting in slow and non-uniform processes. Furthermore, there is not good control over fiber distribution during formation of the fiber mat. That is, there is no way to direct fibers from easily accessible areas of the mold to less accessible areas of the mold therefore producing a mat having a non-uniform distribution of fiber and widely different cross sections. Furthermore, due to the different conditions required for the formation of the fiber mat and for the consolidating and drying of that mat, the prior art processes require the fragile, wet-formed fiber mat to be transferred from a forming mold to a consolidating mold and may require several different transfers of web structure during consolidation and drying to achieve a desired density.

Prior art methods of consolidation use deformable rubber mandrels and/or an inflatable rubber mandrel which are not efficient heat and mass transfer means, and thus consolidation using the prior art techniques is inefficient and produces uncertain outcomes. Furthermore, the rubber-based molds are difficult to design and consolidation ratios in rubber-based molds are severely limited, often requiring multi-stage pressing in progressive molds, which is inefficient at best.

OBJECTS OF THE INVENTION

The main object of the present invention is to fabricate contoured structural products from wet-laid, wood-pulp fiber in an efficient process which produces uniform distribution of fiber in the mold during mat formation and uniform densification of widely different cross sections during consolidation. A porous means in the forming mold permits controlled drainage during mat formation and during consolidation to effect this object.

Another object of the present invention is to fabricate sculptured structural fiberboard products using a single mold structure. The porous means used to effect controlled drainage during mat formation is also used for effecting heat and mass transfer which is controlled according to the rate the fiber mat is being pressed.

Another object of the present invention is to efficiently and rapidly fabricate a laminated structure which has a uniform density.

Another object of the present invention is to provide high ratios of web consolidation in one dimension and equal consolidation of thick and thin sections in a single mold.

Another object of the present invention is to provide a technique which permits rapid and efficient lamination of web elements at any desired consistency/density and which can have a variety of preconsolidation density gradations in the web structure, and furnish variations and/or fiber strand reinforcement between lamina.

These together with other objects and advantages which will become subsequently apparent reside in the details of construction and operation as more fully hereinafter described and claimed, reference being had to the accompanying drawings forming a part hereof, wherein like numerals refer to like parts throughout.

SUMMARY OF THE INVENTION

A sculptured, structural fiberboard product is formed in a mold which includes porous forming mandrels movably mounted on that mold. A movable thimble is associated with each forming mandrel and a pressing platen is also movably associated with the mold. Movements of the thimbles, the forming mandrels and the pressing platen are all controlled and coordinated.

The porous mandrels permit the distribution of fiber in a fiber/liquid slurry "furnish" to be controlled during formation of a fiber network by initially masking the porous areas which are in the most accessible portions of the mold. This forces drainage through less accessible areas so the density of the fiber network formation in difficult-to-fill areas equals that in the more accessible areas. The amount of drainage is controlled by gradually unveiling the porous mandrels as the fiber mat builds in thickness so that the reduction in drainage due to the mat build-up is offset by an increase in porous area. Furthermore, the surface area of the porous forming mandrels can be 10 to 30 times higher than that area located between the mandrels, thereby accelerating the drainage rate over prior art methods and reducing the time required to form a web structure.

During consolidation, which occurs in the same mold, the liquid is forced out of the fiber mat via the porous forming mandrels as a pressing platen is lowered toward those mandrels. The mandrels can be withdrawn, and the ratio of withdrawal can be controlled in cooperation with the rate of movement of the pressing platen whereby uniform densification occurs and thick and thin sections of the web structure experience equal volumetric reduction. Heat can also be transferred to the fiber mat through the porous forming mandrels and dry steam can be ingested into the mold via the porous forming mandrels, and pressure relief valves can be included to further control the consolidation process.

An alternative embodiment permits efficient formation of laminated structures which have a uniform density.

BRIEF DESCRIPTION OF THE DRAWINGS

FIG. 3 illustrates an alternative embodiment of the means and method embodying the present invention; and FIGS. 4*a*–4*c* and 5*a*–5*d* illustrate an embodiment in which a laminated product is formed in accordance with the principles of the present invention.

DETAILED DESCRIPTION OF A PREFERRED EMBODIMENT

Figure 1A:
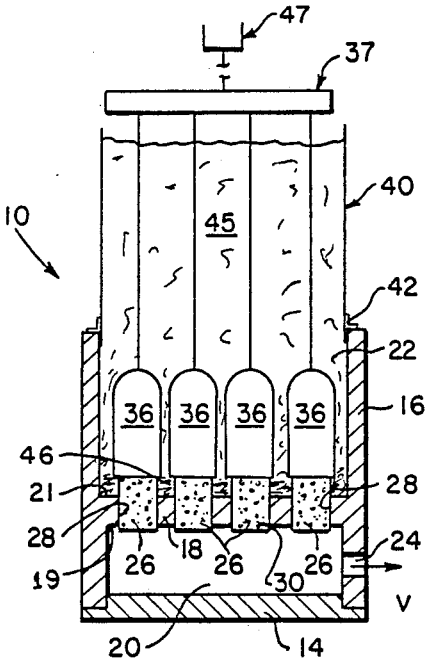
FIGS. 1*a*–1*c* illustrate the means and method for forming a fiber mat in accordance with the present invention.

Shown in FIG. 1 is a mold 10 for forming, consolidating and drying sculptured, structrual fiberboard products. The mold 10 rests on a suitable support 14 and includes a side wall 16 and a bottom plate 18 spaced from the support 14 to have a lower surface 19 defining a chamber 20 with the support 14 and an upper surface 21 defining a chamber 22 with the wall 16. Chamber 20 is a vacuum chamber and is connected to a vacuum means (not shown) via a port 24 for purposes to be discussed below, and chamber 22 is a slurry receiving chamber, as will also be discussed below.

A plurality of porous forming mandrels 26 are mounted in bores 28 defined in the bottom plate. The mandrels 26 are formed of a porous metal, such as bronze, and have a multiplicity of pores, such a pore 30, defined therein to fluidically connect the exterior surface of the mandrel to the interior surface to form a mass transfer path through the mandrel. Preferably, the mandrels 26 are orthogonally arranged and each mandrel has a 2×2 inch square cross-section. The mandrels in the preferred form are about six inches long and have a forty micron pore size. The mandrels can include a core encased in a porous covering, but preferably are hollow having a wall thickness of 5/16 inch. The mandrels are movably mounted in the bottom plate, but need not be moved in the mat forming process, and the mandrel moving means is not shown in FIGS. 1*a*–1*c* for the sake of clarity. Each mandrel includes a bottom surface 32 located to be in fluid communication with the vacuum chamber whereby fluid communication between the vacuum chamber 20 and the slurry chamber 22 is established via the porous mandrels 26.

Each mandrel has a thimble 36 associated therewith for covering or masking it. The thimbles are connected to a means 37 (indicated schematically in only FIG. 1*a* for the sake of clarity) for moving the thimbles off of the mandrels to expose, or unveil, the mandrels. The unveiling exposes more mandrel surface area to chamber 22 to increase the amount of fluid connection between chambers 20 and 22. The unveiling takes place at a rate set according to considerations that will be evident from the ensuing discussion.

A stock tank 40 is associated with the mold and is removably connected thereto via flanges 42 to close chamber 22 for defining a receptable in which a fiber/-liquid slurry "furnish" 45 is stored.

The mold 10 is simple and versatile and the movable porous forming mandrels make it possible to form a fiber mat of uniform fiber distribution and, using the same mold 10, consolidating and drying that fiber mat to a uniform densification.

The process of forming, consolidating and drying the fiberboard product is illustrated in FIGS. 1*a*–1*c* and FIGS. 2*a*–2*c*. A low-density fiber mat is first formed from the fiber/liquid slurry 45 by the process shown in FIGS. 1*a*–1*c*. The slurry is first introduced to the chamber 22 with the mandrels nearly fully masked and thus some of the fibers begin to deposit on the bottom plate upper surface 19 adjacent to the base of the mandrels as indicated at 46 in FIG. 1*a*. This initial deposition of fibers is controlled by drawing a controlled vacuum on chamber 20 as indicated by arrow V in FIG. 1*a* and unveiling the thimbles as required to establish the necessary initial conditions. The vacuum in chamber 20 establishes, via the porous mandrels, a fiber movement in the slurry towards the bottom plate. Liquid is drawn from the furnish through the porous mandrels. A control means 47 associated with thimble moving means 37 can be used to move the thimbles together, individually and/or in any suitable combination, to produce a desired fiber distribution and/or deposition rate and movement direction. The control means 47 can be mechanical, electrical or a combination thereof and can be controlled by a suitable computer program. State sensing devices, such as pressure gauges, temperature gauges or the like, as well as timers, can be associated with the chamber 22, and/or the deposited fiber areas adjacent to the mandrels and connected to the control means 47 and the moving means 37. Additionally, the mandrels 26 can be arranged in any suitable configuration, such as staggered, waffle-like or any other configuration suitable for providing the desirable fiber mat. Still further, the mandrels can have a shape other than the rectangular cross-sectional shape shown in the Figures. Bullet-shaped mandrels, or other polygonal shapes, may be suitable for particular applications. The mandrels 26 can also be moved during the mat forming process if suitable by connecting them either individually or together or in selected groups to the mandrel forming means (which will be discussed below) during the mat forming process. The control means 47 can be associated with the mandrel moving means to control movement of the mandrels.

Figure 1B:
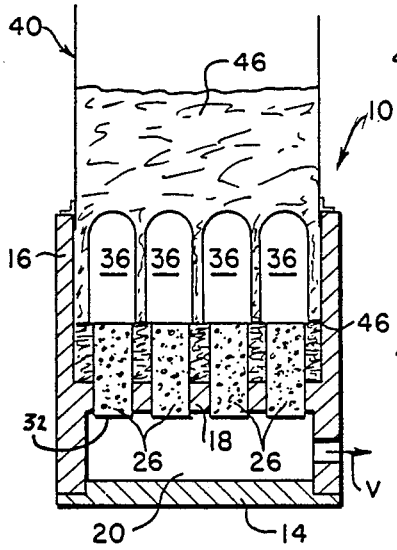

As the thickness of the deposited fiber layer increases, the thimbles are gradually withdrawn as shown in FIG. 1*b*. The rate of thimble withdrawal is adjusted according to the deposition rate of the fiber, as well as other conditions as will appear to those skilled in the art based on this disclosure. As the forming mandrels are unmasked, more surface area is exposed thereby increasing the area of fluid connection established between chambers 20 and 22.

Figure 1C:
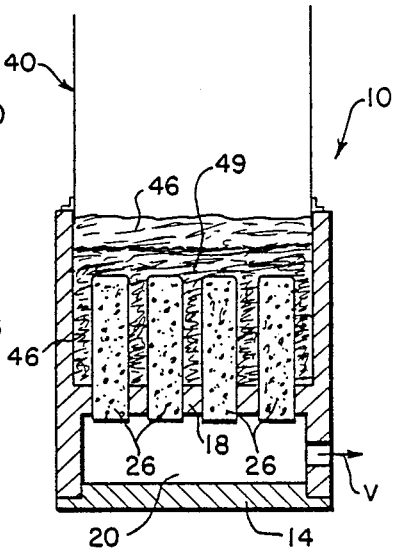

The unveiling and fiber deposition processes continue until the thimbles are fully withdrawn exposing the full porous surfaces of the mandrels and the fiber layer has a thickness which exceeds the height of the mandrels as shown in FIG. 1*c* to form a fiber layer 49. The fiber layer 49 covers the tops of the mandrels and forms a fiber facing which forms over the waffle-like fiber structure laid between the mandrels. A vacuum is maintained in chamber 20 at a level suitable for defining the proper density for the fiber mat.

By adjusting the withdrawl rate of the thimbles, as well as the amount of vacuum in chamber 20, the drainage from chamber 22 is controlled to direct fibers into less accessible areas of the mold and thus force the web to form in those less accessible areas. The unmasking rate can also be controlled to ensure proper fiber mat formation in the more accessible areas as well. By varying the rate of unmasking, the fiber density at any location in the mat can be set to a desired level. In fact, the thimbles can be controlled individually so that fiber density in both the radial and the axial directions (with respect to the mold) can be varied as suitable. Various state property measuring gages, such as pressure and temperature gages, as well as timers, can be used to assist in obtaining the desired densification of the mat. The techniques disclosed herein can also be used to vary the type of furnish used in designated portions of the finished structural product.

Figure 2A:
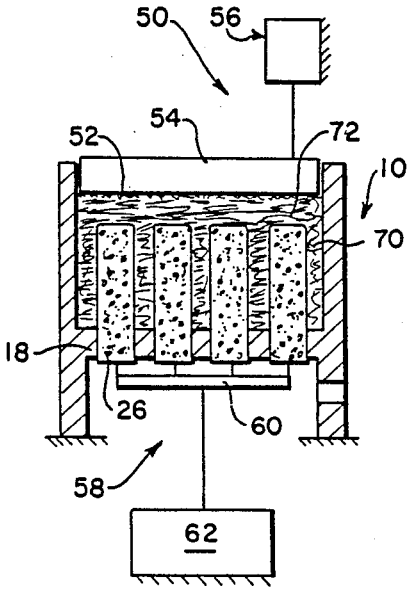
FIGS. 2*a*–2*c* illustrate the means and method for consolidating and drying of the fiber mat in accordance with the present invention.
Figure 2B:
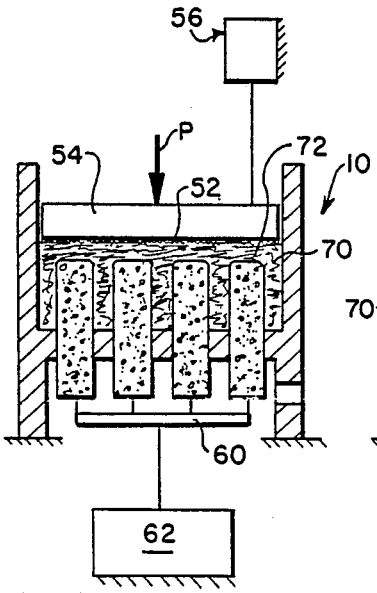
Figure 2C:
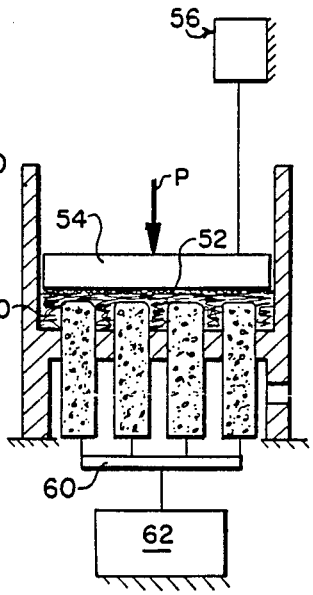

Once the fiber mat is formed, it is consolidated and dried in the same mold to a uniform densification by using the porous forming mandrels as heat and mass transfer means. The consolidating and drying process is shown in FIGS. 2a–2c. The stock tank 40 is replaced by a pressing means 50 which includes a foraminous wire screen 52, a pressing platen 54 and a moving means and a platen displacement sensor 56. The mandrels 26 are moved by a mandrel moving means 58, which includes a beam 60 and a moving means and mandrel displacement sensor 62. It is noted that beam 60 is located in the vacuum chamber 20 which has been cut away in FIGS. 2a–2c for the sake of clarity. The means 56 and 62 are cooperatively connected together for a purpose which will appear from the ensuing disclosure.

The consolidation and drying process occurs when a pressing force is applied by pressing means 50 as indicated by arrow P in FIG. 2b. Liquid is forced from the wet mat through the porous mandrels and the web structure begins to consolidate. The mandrels are withdrawn during the consolidation process at a rate adjusted so that consolidation occurring in thick web sections 70 between the mandrels, corresponding to deposition areas 46 in FIG. 1a, is the same as the consolidation which occurs in the thin section 72 over the tops of the mandrels which corresponds to the fiber layer 49 in FIG. 1c.

The displacement sensors in the means 56 and 62 cooperate to coordinate the rate of mandrel withdrawal with the rate of platen advance to establish the desired degree and rate of densification. The cooperative coordination can be achieved mechanically, electrically or by means of a suitably programmed computer. Again, state properties can be measured and used as factors in this coordination process step. Time can also be used, and the mandrel movement controlled as above discussed so individual or groups of mandrels are suitably moved at rates selected for effective consolidation and drying. The consolidation continues until the desired densification is achieved. For example, FIG. 2c represents a consolidation ratio of 5:1 from the wet-laid web.

Once the desired level of consolidation has been achieved, pressing action can be stopped and any remaining moisture in the web can be driven out by heating the web via the mold wall 16, the platen 54 or the mandrels 18. The moisture exits the web in the form of water vapor and moves through the porous mandrels.

The following are approximate ranges of operation for fabrication of structural boards:

| | |
|---|---|
| Furnish consistency | .5%–2% |
| Consolidation ratio | 4x to 10x |
| Drying temperatures | 250° F.–400° F. |

Consolidation and drying of the web structure may also be accelerated during the process shown in FIGS. 2a–2c by the injection of dry steam into the web structure in the manner disclosed by R. L. Geimer, Steam Injection Pressing, for accelerating the densification and drying of flat particleboards. Steam may be injected either through the pressing platen or through the porous mandrels.

Difficulties related to fiber adhesion and plugging of the porous mandrels during the wet-lay forming process may be relieved by wet-laying a very thin veneer of porous ribbons or flakes on the mandrels prior to formation of the web structure. This porous veneer would be stripped from the mandrels as they are withdrawn in the consolidation process. Alternatively, the mandrels may also be covered with a preformed porous "skin" prior to starting formation of the fiber network. This skin would be stripped during the consolidation process as the porous mandrel is withdrawn.

FIG. 3 shows an alternate embodiment 10′ of the mold in which the forming and consolidating apparatus is modified so that the consolidated web structure is dried in a pressurized environment at a controlled temperature above 100° C. In FIG. 3, the mold 10′ includes locking pins 80 which hold the pressing platen 54 in a pressing orientation. A pressure relief valve 82 is located on the mold and a pressure seal 86 is mounted on the platen 54 to prevent leakage. The bottom plate 14 is secured to the mold wall in a leaktight manner and heat is supplied to the web via the pressing platen 54, mold wall 16, and via the porous mandrels 26. The heat addition causes water in the web structure to vaporize which increases the pressure in the chamber bounded by the pressing platen 54, the mold wall and the bottom plate 16. Chamber pressure is limited by the relief valve 82. Since temperature at which water in the web structure is vaporized and leaves the web is influenced by the pressure in the chamber, the relief valve 82 can be set to control the drying temperature of the web.

FIGS. 4a–4c and 5a–5c illustrate an alternative means of forming a uniform density web structure. This alternative forming method uses a separate forming apparatus 10″ (illustrated in FIGS. 4a and 4b) to create multiple web-elements which are subsequently laminated to form a web structure (according to a process illustrated in FIGS. 5a–5d) and then consolidated and dried as previously disclosed (FIGS. 2a–2c).

The alternative web-forming apparatus 10″ includes a receptacle 90 having a side wall 92, a bottom wall 94 and a plurality of shoulders, such as shoulders 96 and 98 defined in the inner surface of the side wall. A vacuum port 100 is positioned in the side wall below the lowermost shoulder and a porous base plate 102 rests on that lowermost shoulder to define a vacuum chamber 104 with the lower portion of the receptacle. A plurality of spacers 108 are mounted in bores 110 defined in the base plate and project upwardly from the chanber 104 through the base plate and the space above that base plate. A low consistency fiber/water slurry 112 is located in the receptacle above the porous base plate to begin the alternative process. When a vacuum is drawn in chamber 104 via port 100, water is drawn from the slurry through the porous base plate 102 to form a fiber web-element 114 in the areas between the spacers as shown in FIG. 4b in a manner similar to that described above whereby fiber distribution is controlled, as above-discussed.

The porous base plate 102 and spacers 108 are then lifted from receptacle shoulder 98, with the web-element 114 intact, as in FIG. 4c. The web-element is then transferred to the consolidating and drying apparatus in the manner described below.

The lamination of the overall web element according to the alternative process is shown in FIGS. 5a–5d. Referring first to FIG. 5a, the web-element 114, base plate 102 and spacers 108 have been inverted from the FIG. 4c orientation and placed into the mold 10 of the consolidating and drying apparatus described previously with respect to FIG. 2. The porous mandrels 26 are shown in FIG. 5a in a withdrawn position and the apparatus is supported on a block 120.

In FIG. 5b, the base plate 102 and the web element 114 associated therewith have been placed on the mold bottom plate 18 with the spacers 108 aligned with the porous forming mandrels 26. As the base plate is forced in the direction indicated by arrows B, the spacers 108 are forced out of the base plate as a result of their contact with the supported forming mandrels. The spacers 108 ar sized to correspond to the size of the mandrels so that web-element 114 is transferred to the areas between the mandrels as shown in FIG. *5b*. The web-element 114 thus forms a first lamina of a waffle-like structure being formed. FIG. *5c* shows a second web-element 114' on a porous base plate 102 with spacers 108 ready to be placed in the mold 10 on top of the first lamina 114. The second web-element 114' thus forms the second lamina. As indicated in FIG. *5c*, the porous forming mandrels are forced into the mold from the FIG. *5b* position so the FIG. *5c* mandrel position locates the top surfaces of the forming mandrels above top surface 122 of the first lamina so that the mandrels 26 will force the spacers 108 out of the second web-element 114' in a manner similar to the action discussed in relation to FIG. *5b* for the first lamina.

In FIG. *5d*, this second web-element 114' is inserted in the frame 102 in the direction B. The frame 102 is displaced downward on the porous mandrels 26, and the second web-element 114' is transferred into the areas between the porous mandrels. By repeating this process, multiple web-elements can be laminated to form a uniform density web structure in the consolidation and drying apparatus. It is an alternative approach to the forming method depicted in FIG. 1. Any loss in bonding at the interface of web-element lamina can be offset by applying an adhesive between the lamina. Furthermore, furnish variations and/or fiber strand reinforcement between lamina can be provided if suitable. A facing sheet can be formed in ways well known in the art. It is further noted that, in this FIGS. *4a–4c* and *5a–5d* embodiment, the formed web need not be removed from the support provided by the porous base plate 102, yet that base plate acts to drain liquid in the manner of the porous mandrels 26 during the web forming process. In this manner, the structural integrity of a fragile web is not compromised during transport from one location to another.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to which fall within the scope of the invention.

I claim:

1. Means for forming, consolidating and drying sculptured, structural fiberboard products from a slurry which is subject to having fiber-containing areas therein which are thick and thin relative to each other during the forming, consolidating and drying process, the means comprising:

a frame having a bottom plate defining with said frame an interior volume via said bottom plate which is adapted to contain a fiber containing slurry which is to be consolidated during the formation of a fiberboard product;

an elongate porous forming mandrel movable mounted in said bottom plate to be moved into and out of said interior volume, said elongate forming mandrel having a side surface which extends axially of said forming mandrel and a top end extending transversely of said forming mandrel;

forming mandrel moving means;

mandrel control means for controlling movement of said forming mandrel out of said interior volume;

a pressing platen movably mounted in said interior volume to be moved toward said bottom plate and toward said mandrel top end;

pressing platen moving means;

pressing platen control means for controlling movement of said pressing platen toward said bottom plate; and connecting means for cooperatively connecting said mandrel control means and said pressing platen control means together for adjusting the movements of said forming mandrel and said pressing platen with respect to each other so that consolidation occurring adjacent to said mandrel side surface occurs at essentially the same rate as consolidation occurring between said mandrel top end and said pressing platen.

2. The means defined in claim 1 further including mandrel covering means movably mounted on said forming mandrel and covering means moving means for withdrawing said mandrel covering means from said forming mandrel at a prescribed rate.

3. The means defined in claim 2 further including a plurality of porous forming mandrels.

4. The means defined in claim 2 further including means for heating said porous mandrel.

5. The means defined in claim 1 further including porous skin means removably mounted on said forming mandrel.

6. The means defined in claim 2 further including locking means on said frame for locking said pressing platen in a predetermined position on said frame and pressure relief valve means on said frame for controlling drying temperature by controlling pressure of any water remaining in said interior volume.

7. Means for forming, consolidating and drying sculptured, structural fiberboard products comprising:

a mold means into which a fiber/liquid slurry is charged and for forming a fiber mat and for consolidating and drying said fiber mat, said mold means including a bottom plate and said fiber/liquid slurry being subject to having fiber-containing areas therein which are thick and thin relative to each other during the forming, consolidating and drying of said fiber mat;

an elongate porous forming mandrel movably mounted on said mold means to be movable into said mold means via the bottom plate thereof;

a pressing platen movably mounted on said mold to be moved toward said bottom plate;

adjusting means for adjusting the consolidation of said fiber mat, said adjusting means including means for withdrawing said mandrel from said mold and means for moving said pressing platen toward said bottom plate, and control means for adjusting the movements of said mandrel and said pressing platen to be in cooperation with each other so that the consolidation of the thick areas of the fiber-containing slurry occurs at essentially the same rate as the consolidation of the thin areas of the fiber-containing slurry.

8. The means defined in claim 7 further including means for changing the size of said porous areas which is exposed to the interior of said mold.

* * * * *